US009075363B2

(12) United States Patent
Monahan et al.

(10) Patent No.: US 9,075,363 B2
(45) Date of Patent: Jul. 7, 2015

(54) METHOD AND APPARATUS FOR REDUCING RELEASE AGENT TRANSFER TO A PRESSURE MEMBER IN A FUSER

(75) Inventors: Melissa Ann Monahan, Rochester, NY (US); Erwin Ruiz, Rochester, NY (US); Steven Russel, Bloomfield, NY (US); Jeffrey Nyyssonen Swing, Rochester, NY (US); Christopher Alan Jensen, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 95 days.

(21) Appl. No.: 13/525,236

(22) Filed: Jun. 15, 2012

(65) Prior Publication Data

US 2013/0336687 A1 Dec. 19, 2013

(51) Int. Cl.
*G03G 15/20* (2006.01)

(52) U.S. Cl.
CPC ..... *G03G 15/2067* (2013.01); *G03G 15/2025* (2013.01); *G03G 15/2075* (2013.01); *G03G 2215/2093* (2013.01); *G03G 15/20* (2013.01); *G03G 15/2032* (2013.01); *G03G 2215/2083* (2013.01)

(58) Field of Classification Search
USPC ..... 399/325, 332
See application file for complete search history.

(56) References Cited

U.S. PATENT DOCUMENTS

| | | | | |
|---|---|---|---|---|
| 3,998,584 | A * | 12/1976 | Wada et al. | 432/60 |
| 4,954,845 | A * | 9/1990 | Yano et al. | 399/329 |
| 5,055,884 | A * | 10/1991 | Ndebi et al. | 399/320 |
| 6,411,785 | B1 * | 6/2002 | Ogawahara et al. | 399/69 |
| 6,819,890 | B1 | 11/2004 | Bott et al. | |
| 2003/0108370 | A1 * | 6/2003 | Chen et al. | 399/328 |
| 2006/0056886 | A1 * | 3/2006 | Ohishi et al. | 399/322 |
| 2007/0177913 | A1 * | 8/2007 | Russel et al. | 399/323 |

* cited by examiner

*Primary Examiner* — Benjamin Schmitt
(74) *Attorney, Agent, or Firm* — Ronald E. Prass, Jr.; Prass LLP

(57) ABSTRACT

An approach is provided for reducing release agent transfer to a pressure member in a fuser. The approach involves causing, at least in part, at least a first sheeted substrate and a second sheeted substrate to be advanced through a fuser in a process direction. The approach also involves determining the presence of the first sheeted substrate at a fusing position. The approach further involves causing, at least in part, a fuser member and a pressure member to engage to form a fusing nip at the fusing position based, at least in part, on the determined presence of the first sheeted substrate at the fusing position. The approach additionally involves determining the first sheeted substrate has advanced through the fusing nip. The approach further involves causing, at least in part, the fuser member and the pressure member to disengage.

12 Claims, 3 Drawing Sheets

METHOD AND APPARATUS FOR REDUCING RELEASE AGENT TRANSFER TO A PRESSURE MEMBER IN A FUSER

FIELD OF DISCLOSURE

The disclosure relates to a method and apparatus for reducing release agent transfer to a pressure member in a fuser.

BACKGROUND

Conventional print systems that incorporate a fuser portion often have image related defects that occur when subjecting a substrate to duplex printing. In duplex printing, a substrate having a first surface and a second surface has one or more images applied to each of the first surface and the second surface by one or more photoreceptors.

In a conventional print system, one or more images that are applied to one or more of the first surface and the second surface of a substrate are later fused to the substrate by the fuser portion. To fuse an image to a substrate, the fuser portion often comprises a fuser member, such as a fuser roll or belt, and a pressure member, such as a pressure roll or belt. The fuser member and the pressure member, together, form a fusing nip through which the substrate may pass for fusing the one or more images to the substrate. The substrate is under a pressure in the fusing nip because the fuser member and the pressure member are either in contact with one another in the fusing nip, or at least very close to one another in the fusing nip such that when the substrate passes through the fusing nip, a pressure is applied.

A release agent applicator in a conventional print system applies a layer of release agent to the fuser member, for example, to aid in stripping the sheeted substrate from the fuser member after the substrate passes through the fusing nip. The release agent may be, for example, an oil, lubricant, or other substance that reduces an adhesion that may occur between the substrate and the fuser member, The release agent applied to the fuser member often transfers to the surface of the substrate that contacts the fusing member.

If, for example, the substrate is a sheeted substrate, and a printing run applies images to more than one sheeted substrate, as a first sheeted substrate advances through the fuser portion of the printing system, there is often a gap between the first sheeted substrate and a second sheeted substrate. This gap continually occurs between any subsequent sheeted substrate and a substrate before it that may be processed by the print system during a print run of any number of sheets. This gap is commonly known as the inter-document zone.

When the inter-document zone occurs, i.e. there is no paper in the fusing nip, release agent often transfers to the pressure member from the fuser member. The release agent that transfers to the pressure member accumulates and/or transfers to the surface of a subsequent sheeted substrate that contacts the pressure member as the sheeted substrate passes through the fusing nip. For example, if the first surface of the substrate is in contact with the fuser member when passing through the fusing nip, the second surface of the substrate is in contact with the pressure member. While an image applied to the first surface is being fused to the first surface of the substrate, release agent is often transferred from the pressure member to the second surface of the substrate.

It is this transfer of release agent to the second surface of the substrate that causes image related defects in duplex printing modes. After the image is fused to the first surface of the substrate, the second surface of the substrate then has an image applied to it as well. Because the second surface of the substrate has release agent on it, this release agent is often transferred from the substrate to a photoreceptor belt that applies an image to the second surface of the substrate in duplex printing. The photoreceptor belt may be the same or a different photoreceptor belt as that which applies the image to the first surface of the substrate. Release agent build up on the photoreceptor belt may cause image related defects to either or both of the first surface and second surface images, depending on how the conventional print system is set up to conduct duplex printing, as release agent is continually transferred to the photoreceptor belt from the pressure member by way of the second surface of the substrate.

SUMMARY

Therefore, there is a need for an approach to reduce release agent transfer to a pressure member in a fuser.

According to one embodiment, a method comprises causing, at least in part, at least a first sheeted substrate and a second sheeted substrate to be advanced through a fuser in a process direction. The method also comprises determining the presence of the first sheeted substrate at a fusing position. The method further comprises causing, at least in part, a fuser member and a pressure member to engage to form a fusing nip at the fusing position based, at least in part, on the determined presence of the first sheeted substrate at the fusing position. The method additionally comprises causing, at least in part, the first sheeted substrate to be advanced through the fusing nip in the process direction. The method also comprises determining the first sheeted substrate has advanced through the fusing nip. The method further comprises causing, at least in part, the fuser member and the pressure member to disengage. The method additionally comprises determining the presence of the second sheeted substrate at the fusing position. The method also comprises causing, at least in part, the fuser member and the pressure member to re-engage to form the fusing nip at the fusing position. The method further comprises causing, at least in part, the second sheeted substrate to be advanced through the fusing nip in the process direction.

According to another embodiment, an apparatus comprises at least one processor, and at least one memory including computer program code for one or more computer programs, the at least one memory and the computer program code configured to, with the at least one processor, cause, at least in part, the apparatus to cause, at least in part, at least a first sheeted substrate and a second sheeted substrate to be advanced through a fuser in a process direction. The apparatus is also caused to determine the presence of the first sheeted substrate at a fusing position. The apparatus is further caused to cause, at least in part, a fuser member and a pressure member to engage to form a fusing nip at the fusing position based, at least in part, on the determined presence of the first sheeted substrate at the fusing position. The apparatus is additionally caused to cause, at least in part, the first sheeted substrate to be advanced through the fusing nip in the process direction. The apparatus is also caused to determine the first sheeted substrate has advanced through the fusing nip. The apparatus is further caused to cause, at least in part, the fuser member and the pressure member to disengage. The apparatus is additionally caused to determine the presence of the second sheeted substrate at the fusing position. The apparatus is also caused to cause, at least in part, the fuser member and the pressure member to re-engage to form the fusing nip at the fusing position. The apparatus is further caused to cause, at least in part, the second sheeted substrate to be advanced through the fusing nip in the process direction.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments of the invention are illustrated by way of example, and not by way of limitation, in the figures of the accompanying drawings.

DETAILED DESCRIPTION

Examples of a method, apparatus, and computer program for reducing release agent transfer to a pressure member in a fuser are disclosed. In the following description, for the purposes of explanation, numerous specific details are set forth in order to provide a thorough understanding of the embodiments of the invention. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

Figure 1:
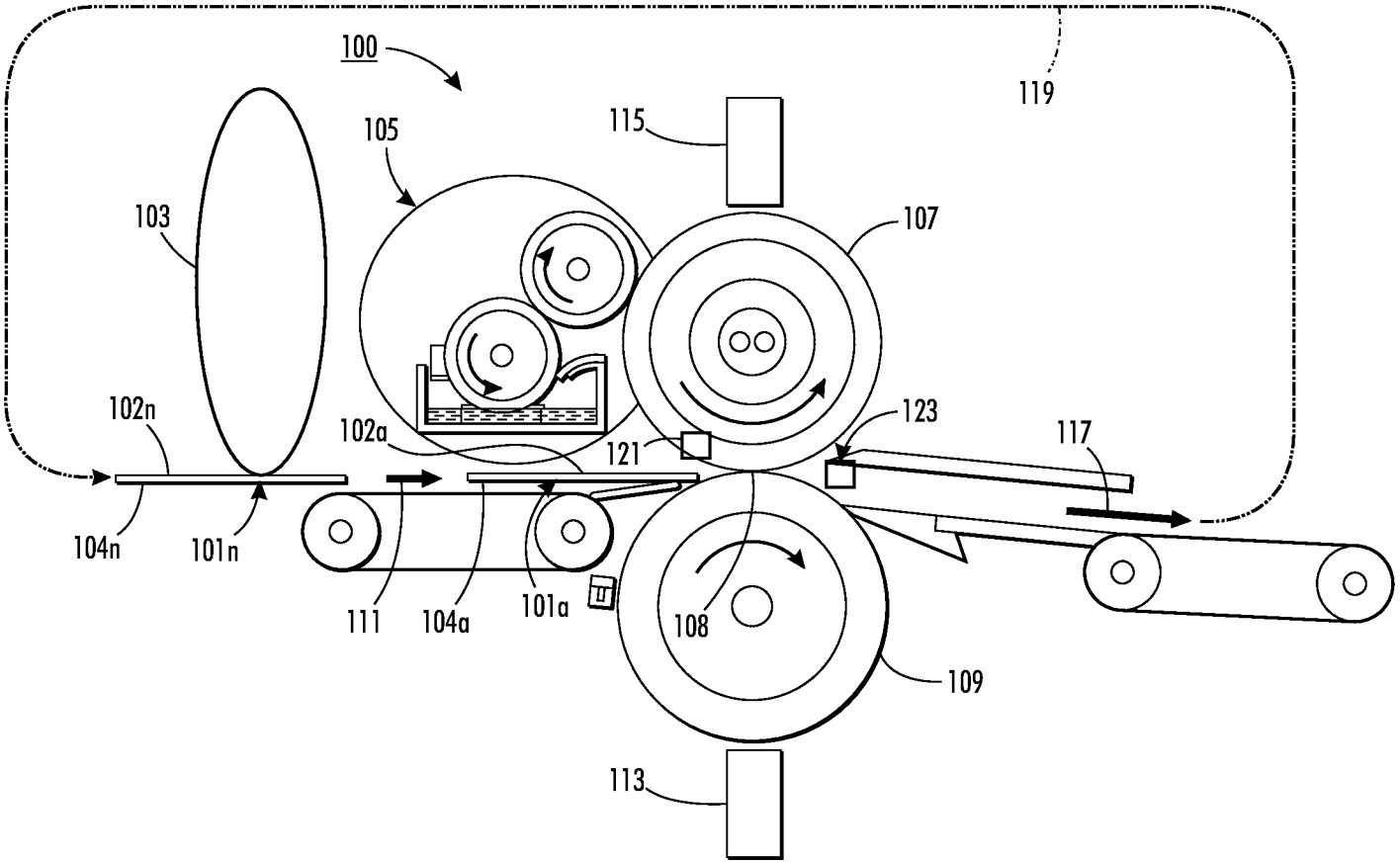
FIG. 1 is a diagram of a system capable of reducing release agent transfer to a pressure member in a fuser, according to one embodiment.

FIG. 1 is a diagram of a system capable of reducing release agent transfer to a pressure member in a fuser, according to one embodiment.

Conventional print systems, as discussed above, transfer release agent to a surface of a substrate by way of release agent build up on a pressure member. The release agent build up causes image related defects in duplex printing modes. For example, such defects occur in duplex printing because after an image is fused to a first surface of a sheeted substrate, another image is applied to a second surface of the sheeted substrate by a same or different photoreceptor belt. Because the second surface of the substrate has release agent on it as a result of contacting a pressure member when the sheeted substrate passes through a fusing nip, this release agent is often transferred to the photoreceptor belt that applies an image to the second surface of the substrate. Release agent build up on the photoreceptor belt causes image related defects to either or both of the first surface and second surface images that are applied to the same or subsequent sheeted substrates that are processed by conventional print systems as release agent is continually transferred to the photoreceptor belt from the pressure member by way of the second surface of the substrate, and any subsequent sheeted substrate.

To address these problems, a print system 100 of FIG. 1 introduces the capability to reduce release agent transfer to a pressure member in a fuser. Such reduction in release agent transfer accordingly mitigates the aforementioned image related defects because by reducing the amount of release agent transferred to the pressure member, the amount of release agent further transferred to the photoreceptor belt by way of the substrate is also reduced. Additionally, the life span of a photoreceptor belt that is part of the print system 100 may be increased, thereby reducing cost and waste. Further, any misdiagnoses of causes for image related defects blamed on the fuser roll because of release agent build up on the photoreceptor belt may be reduced.

According to various embodiments, as will be discussed in more detail below, the print system 100 is configured to cause the contact or closeness of a fuser member and a pressure member that form a fusing nip to cease for a duration of time associated with the inter-document zone discussed above to reduce the amount of release agent transferred to the pressure member. By reducing the amount of release agent that is transferred to the pressure member, there is an overall reduction in an amount of release agent transferred to the photoreceptor belt, which in turn, results in a reduction of image related defects caused by excess release agent on the photoreceptor belt.

As shown in FIG. 1, the print system 100 is configured to print one or more images on one or more substrates 101*a*-101*n* (collectively referred to as substrate 101) having corresponding first surfaces 102*a*-102*n* (collectively referred to as first surface 102) and corresponding second surfaces 104*a*-104*n* (collectively referred to as second surface 104) by any of simplex or duplex printing. As discussed herein, "n" such as 101*n*, for example, refers to an infinite number of subsequent sheeted substrates and respective surfaces. Any reference numeral discussed such as a second substrate 101*b* should be understood as a substrate that follows sequentially after the first substrate 101*a*, third substrate 101*c* follows second substrate 101*b*, etc.

A first substrate 101*a* is illustrated as passing through the print system 100 before a subsequent substrate 101*n* (which may be a second substrate 101*b*, for example) that follows sequentially after the first substrate 101*a* has had at least one image applied to its first surface 102*a*. Depending on how the print system 100 is setup to perform duplex printing, the first substrate 101*a* may have an image applied to its first surface 102*a* and then its second surface 104*a* before a second substrate 101*b* has an image applied to its respective first surface 102*b*, or the second substrate 101*b* may follow the first substrate 101*a* through all steps of a duplex printing process. Regardless, there will always be an inter-document zone between the first substrate 101*a*, the second substrate 101*b*, and any subsequent substrate 101*n* that is processed by print system 100.

According to various embodiments, the print system 100 comprises a photoreceptor belt 103, a release agent application module 105, and a fuser member 107 that forms a fusing nip 108 with a pressure member 109.

In one or more embodiments, the photoreceptor belt 103 is configured to apply one or more images to the first surface 102 and/or the second surface 104 of substrate 101, depending on whether the substrate is to be subjected to simplex or duplex printing. Any image applied to the substrate 101, however, may be applied by any means that may be in addition to, or as an alternative of being applied by the photoreceptor belt 103, such as, for example, one or more other photoreceptor belts. In this example, the substrate 101 having an applied image moves through the print system 100 from the photoreceptor belt 103 to the fusing nip 108 in a process direction. 111.

The release agent application module 105 applies release agent such as an oil to the fuser member 107. When a sheeted substrate 101 passes through the fusing nip 108, release agent is applied to the surface of substrate 101 that contacts the fuser member 107 in the fusing nip 108. In this example, the surface that contacts the fuser member 107 in the fusing nip 108 is the first surface 102, but the surface that contacts the fuser member 107 may be the second surface 104 in alternative embodiments, or on a duplex printing pass, for example.

As the substrate 101 passes through the fusing nip 108, the image applied to the substrate 101 is fused to the substrate 101 and coated with release agent supplied by the release agent application module 105. The release agent applied to the substrate 101 aids in stripping the substrate from the fuser member 107, protects the fuser member 107 from contaminants, The substrate 101, having the fused image and release agent coated surface, then progresses through the print system in a process direction 117.

If the substrate 101 is subjected to simplex printing, the substrate 101, having the fused image is caused to proceed through the print system 100 to completion, or onto any finishing steps that may follow the fusing process described above.

Alternatively, if the substrate is to be subjected to duplex printing, the substrate 101, in this example, is routed back to the print system in duplex printing process direction 119 and inverted such that one or more other images may be applied to the other of the first surface 102 and the second surface 104 of the substrate 101. In this example, the another image is applied to the second surface 104. While the print system 100 illustrates duplex printing process direction 119 as being a process that reruns the substrate 101 through the print system 100 such that the same photoreceptor belt 103 applies the one or more other images to the substrate 101, the print system 100 may be of any configuration that may apply another image to the substrate 101, such as, for example, using another photoreceptor belt or inkjet printing station, another release agent application module, another fuser member, another pressure member, or any combination thereof, that may be located downstream of the illustrated fusing nip 108, or another photoreceptor belt or inkjet printing station that is configured to apply one or more images at the same time as the photoreceptor belt 103, or any time upstream of the photoreceptor belt 103, for example such that the substrate 101 need not follow duplex printing process direction 119 to be subjected to duplex printing.

In this example, however, once the one or more other images are applied to the second surface 104 of substrate 101, the substrate 101 again moves in the process direction 111 through the fusing nip 108 for fusing the one or more images to the second surface 104 of substrate 101 upon which release agent is applied by the fuser member 107 to the second surface 104, as provided by the release agent application module 105.

To mitigate the above-mentioned image defects for duplex printing, the print system 100 may cause the contact or closeness of the fuser member 107 and the pressure member 109 to cease so that the fusing nip 108 is not formed in the inter-document zone discussed above to reduce the amount of release agent that is applied to the pressure member 109 between first substrate 101*a*, second substrate 101*b*, and any subsequent substrate 101*n*. The reduction in transfer of release agent to the pressure member 109, reduces release agent transfer to the photoreceptor belt 103 or another photoreceptor belt that may be used to apply an image to the other of the first surface 102 and second surface 104 of substrate 101 in a duplex printing mode. Accordingly, a reduction in release agent transfer to the pressure member 109 reduces or eliminates the any image defects that may occur on account of a build up of release agent on the photoreceptor belt 103 or other photoreceptor belt because a lesser amount, if any, of release agent is caused to transfer from the fuser member 107 to the pressure member 109. Additionally, a reduction in transfer of release agent to the second surface 104 of the substrate 101 may aid in adhesion and/or absorption of the one or more images applied to the second surface 104 of the substrate 101.

In one or more embodiments, the print system 100 causes, at least in part, at least the first sheeted substrate 101*a* and the second sheeted substrate 101*b* to be advanced through the fusing nip 108 in the process direction 111, as discussed above. There is generally a spacing between the first sheeted substrate 101*a* and second sheeted substrate 101*b* that lasts for a duration on the order of about 60 ms, for example, between a trailing edge of the first sheeted substrate 101*a* and a lead edge of the second sheeted substrate 101*b*. The timing of the inter-document zone, however, may be dependent on many factors such as, but not limited to, a process speed, a sheet length, an intended distance between sheeted substrates 101, etc.

As the first sheeted substrate 101*a* is advanced in the process direction 111 toward the fusing nip 108, the presence of the first sheeted substrate 101*a* is determined to be at a fusing position which may be in the fusing nip 108 area or at an entrance of the fusing nip 108 that is to be formed by the fuser member 107 and the pressure member 109. In one or more embodiments, the presence of the first sheeted substrate 101*a* may be determined based on a lead edge of the first sheeted substrate 101*a* being detected by a sensor 121 to have passed or be at a certain position such as the fusing position, or a process timing upon which the position of the first sheeted substrate 101*a* may be estimated. For example, based on a detection of the lead edge of the first sheeted substrate 101*a* at a particular location, the position of the sheeted substrate 101*a* may be determined based on a process speed measurement and a time of travel from the detected location using, for example, sensor 121.

Based on the determined presence of the first sheeted substrate 101*a*, the print system 100 may cause, at least in part, the fuser member 107 and pressure member 109 to engage to form the fusing nip 108 at the fusing position. In one embodiment, the fuser member 107 and the pressure member 109 are caused to be engaged by way of a pneumatic device 113 configured to move the pressure member 109 toward the fuser member 107. Alternatively, the fuser member 107 be caused to be moved toward the pressure member 109 by a different pneumatic device 115. According to further embodiments, the pressure member 109 may be caused to move toward the fuser member 107 by pneumatic device 113 configured and the fuser member may be caused to move toward the pressure member 109 by the different pneumatic device 115 to form the fusing nip 108.

Once the fusing nip 108 is formed, or as it is forming, the print system 100 causes, at least in part, the first sheeted substrate 101*a* to be advanced through the fusing nip 108 in the process direction 117 to fuse an image applied to the first surface 102*a* to be fused to the first sheeted substrate 101*a*. The print system 100 then determines the first sheeted substrate 101*a* has advanced through the fusing nip. In one or more embodiments, the determination that the first sheeted substrate 101*a* has advanced through the fusing nip 108 is based, at least in part, on a detection of a position of a trailing edge of the first sheeted substrate 101*a* by way of the sensor 121 discussed above, or another sensor 123. Alternatively, the position of the first sheeted substrate 101*a* may be estimated based on a process timing, process speed, sheet length, etc., for example as measured in relation to a predetermined position in within the print system 100 or with respect to any of the sensors 121, 123, for example.

Upon determining that the first sheeted substrate 101*a* has advanced through the fusing nip 108, the print system 100 causes, at least in part, the fuser member 107 and the pressure member 109 to disengage so that the fusing nip 108 is no longer formed to the extent that release agent may be transferred, at least to the same degree as if the fusing nip 108 remained if at all, from the fuser member 107 to the pressure member 109.

According to various embodiments, the print system 100 determines the presence of the second sheeted substrate 101*b*, and any subsequent sheeted substrate 101*n* at the fusing position in the fusing nip 108 by way of any of the methods discussed above such as, but not limited to, a detection of a lead edge of the second sheeted substrate 101*b*, for example, by way of the sensor 121, a process timing associated with an intended gap between the trailing edge of the first sheeted substrate 101*a* and the lead edge of the second sheeted substrate 101*b*, or other subsequent sheeted substrate 101*n*, a process speed at which the print system is running the sheeted substrates 101 through the print system, a length of a subsequent sheeted substrate 101*n*, etc.

Based on the determined presence of the second sheeted substrate 101*b*, the print system 100 causes, at least in part, one or more of the fuser member 107 and the pressure member 109 to re-engage in the same manner as discussed above by way of one or more of pneumatic devices 113 and 115 to form the fusing nip 108 at the fusing position. Upon re-engaging the fuser member 107 and the pressure member 109, the print system 100 causes, at least in part, the second sheeted substrate 101*b* to be advanced through the fusing nip 108 in the process direction 111.

According to various embodiments, the print system 100 causes the same engagement, disengagement and re-engagement of the fuser member 107 and pressure member 109 as any number of sheeted substrates 101*n* are processed by the print system 100. For example, once the print system 100 determines that the second sheeted substrate 101*b* has advanced through the fusing nip, the fuser member 107 and pressure member 109 are caused to disengage so that the fusing nip 108 is not formed and release agent is not caused to transfer to the pressure member 109 from the fuser member 107, at least to the same degree that release agent would have been transferred had the fusing nip 108 remained throughout the inter-document zone between sheeted substrates 101*a*-101*n*.

According to various embodiments, though discussed above primarily as being moved by pneumatic devices, the fuser member 107 and pressure member 109 may also be caused to move by any other means such as a camming mechanism that may replace one or more of pneumatic devices 113 and 115 or other type of motor that may cause a movement of the fuser member 107 and/or pressure member 109 such that the fuser member 107 and pressure member 109 may be disengaged during the inter-document zone, and re-engaged at the optimal moment to form the fusing nip 108 such that an image may be fused to the substrate 101 at the opportune time.

Figure 2:
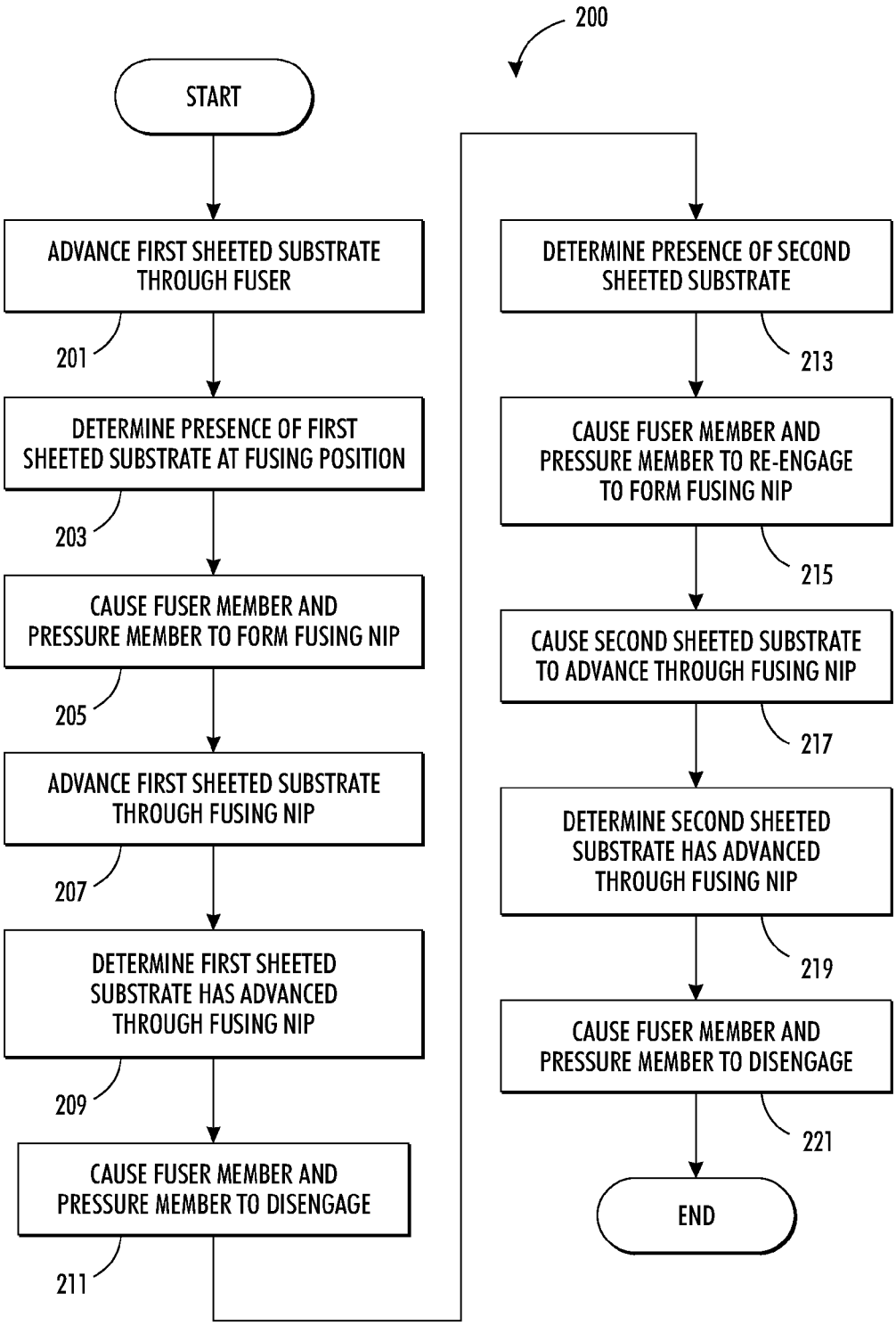
FIG. 2 is a flowchart of a process for reducing release agent transfer to a pressure member in a fuser, according to one embodiment.
Figure 3:
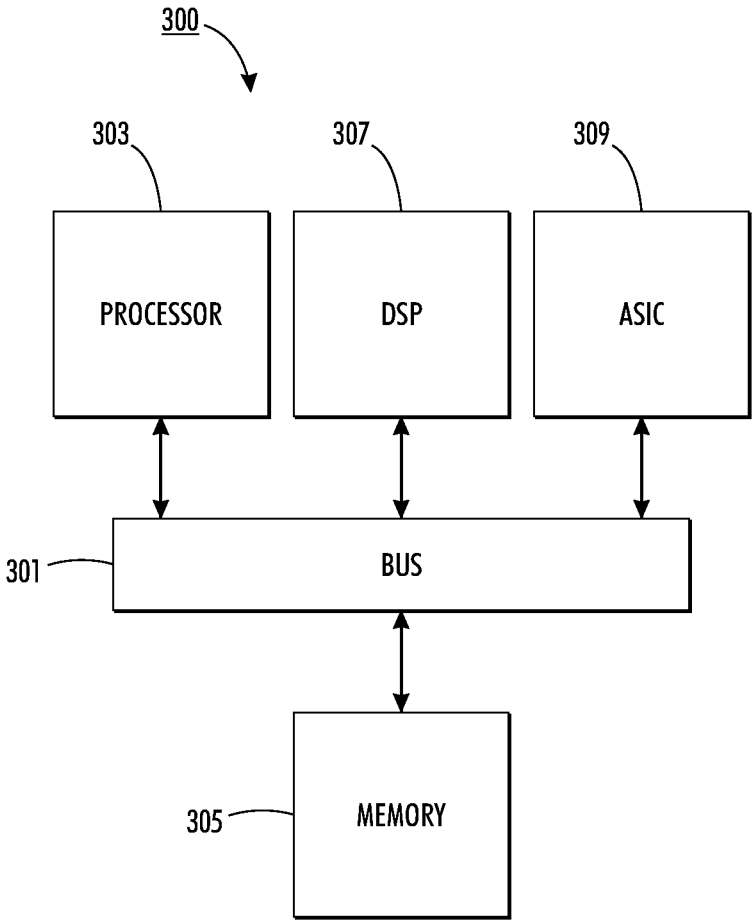
FIG. 3 is a diagram of a chip set that can be used to implement an embodiment.

FIG. 2 is a flowchart of a process for reducing release agent transfer to a pressure member in a fuser, according to one embodiment. In one embodiment, the print system 100 may perform the process 200, which may be implemented by way of for instance, a chip set including a processor and a memory as shown in FIG. 3. In step 201 the print system 100 causes, at least in part, at least a first sheeted substrate 101*a* and a second sheeted substrate 101*b*, as discussed above, to be advanced through a fuser portion of the print system 100 in a process direction 111. Then, in step 203, the print system 100 determines the presence of the first sheeted substrate 101*a* at a fusing position, e.g. a position in the fuser portion of the print system 100 associated with fusing an image to the substrate 101. Next, in step 205, the print system 100 causes, at least in part, a fuser member 107 and a pressure member 109, as discussed above, to engage to form a fusing nip 108 at the fusing position based, at least in part, on the determined presence of the first sheeted substrate 101*a* at the fusing position. The process continues to step 207 in which the print system 100 causes, at least in part, the first sheeted substrate 101*a* to be advanced through the fusing nip 108 in the process direction 111.

Then, in step 209, the print system 100 determines the first sheeted substrate 101*a* has advanced through the fusing nip 108. Next, in step 211 the print system 100 causes, at least in part, the fuser member 107 and the pressure member 109 to disengage. The process continues to step 213 in which the print system 100 determines the presence of the second sheeted substrate 101*b* at the fusing position. Then, in step 215, the print system 100 causes, at least in part, the fuser member 107 and the pressure member 109 to re-engage to form the fusing nip 108 at the fusing position. Next, in step 217, the print system 100 causes, at least in part, the second sheeted substrate 101*b* to be advanced through the fusing nip 108 in the process direction 111.

The process continues to step 219 determining the second sheeted substrate 101*b* has advanced through the fusing nip 108. Then, in step 221, the print system 100 causes, at least in part, the fuser member 107 and the pressure member 109 to disengage. The process 200 may continually repeat as needed for any number of sheeted substrates 101*a*-101*n*, as discussed above.

The processes described herein for reducing release agent transfer to a pressure member in a fuser may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

FIG. 3 illustrates a chip set or chip 300 upon which an embodiment may be implemented. Chip set 300 is programmed to reduce release agent transfer to a pressure member in a fuser as described herein may include, for example, bus 301, processor 303, memory 305, DSP 307 and ASIC 309 components.

The processor 303 and memory 305 may be incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 300 can be implemented in a single chip. It is further contemplated that in certain embodiments the chip set or chip 300 can be implemented as a single "system on a chip." It is further contemplated that in certain embodiments a separate ASIC would not be used, for example, and that all relevant functions as disclosed herein would be performed by a processor or processors. Chip set or chip 300, or a portion thereof, constitutes a means for performing one or more steps of reducing release agent transfer to a pressure member in a fuser.

In one or more embodiments, the chip set or chip 300 includes a communication mechanism such as bus 301 for passing information among the components of the chip set 300. Processor 303 has connectivity to the bus 301 to execute instructions and process information stored in, for example, a memory 305. The processor 303 may include one or more processing cores with each core configured to perform independently. A multi-core processor enables multiprocessing within a single physical package. Examples of a multi-core processor include two, four, eight, or greater numbers of processing cores. Alternatively or in addition, the processor 303 may include one or more microprocessors configured in tandem via the bus 301 to enable independent execution of instructions, pipelining, and multithreading. The processor 303 may also be accompanied with one or more specialized components to perform certain processing functions and tasks such as one or more digital signal processors (DSP) 307, or one or more application-specific integrated circuits (ASIC) 309. A DSP 307 typically is configured to process real-world signals (e.g., sound) in real time independently of the processor 303. Similarly, an ASIC 309 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one or more embodiments, the processor (or multiple processors) 303 performs a set of operations on information as specified by computer program code related to reducing release agent transfer to a pressure member in a fuser. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 301 and placing information on the bus 301. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 303, such as a sequence of operation codes, constitute processor instructions, also called computer system instructions or, simply, computer instructions. Processors may be implemented as mechanical, electrical, magnetic, optical, chemical or quantum components, among others, alone or in combination.

The processor 303 and accompanying components have connectivity to the memory 305 via the bus 301. The memory 305 may include one or more of dynamic memory (e.g., RAM, magnetic disk, writable optical disk, etc.) and static memory (e.g., ROM, CD-ROM, etc.) for storing executable instructions that when executed perform the inventive steps described herein to reduce release agent transfer to a pressure member in a fuser. The memory 305 also stores the data associated with or generated by the execution of the inventive steps.

In one or more embodiments, the memory 305, such as a random access memory (RAM) or any other dynamic storage device, stores information including processor instructions for reducing release agent transfer to a pressure member in a fuser. Dynamic memory allows information stored therein to be changed by print system 100. RAM allows a unit of information stored at a location called a memory address to be stored and retrieved independently of information at neighboring addresses. The memory 305 is also used by the processor 303 to store temporary values during execution of processor instructions. The memory 305 may also be a read only memory (ROM) or any other static storage device coupled to the bus 301 for storing static information, including instructions, that is not changed by the print system 100. Some memory is composed of volatile storage that loses the information stored thereon when power is lost. The memory 305 may also be a non-volatile (persistent) storage device, such as a magnetic disk, optical disk or flash card, for storing information, including instructions, that persists even when the print system 100 is turned off or otherwise loses power.

The term "computer-readable medium" as used herein refers to any medium that participates in providing information to processor 303, including instructions for execution. Such a medium may take many forms, including, but not limited to computer-readable storage medium (e.g., non-volatile media, volatile media), and transmission media. Non-volatile media includes, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. A method for printing comprising:

advancing a sheeted substrate through a fuser in a process direction, the fuser having a fuser member and a pressure member, at least one of the fuser member and the pressure member being movable by action of at least one pneumatic device, the at least one pneumatic device being actuated to a first position to close a fusing nip between the fuser member and the pressure member at a fusing position and being actuated to a second position to open the fusing nip between the fuser member and the pressure member;

applying a release agent to the fuser member;

determining a presence of a leading edge of the sheeted substrate at the fusing position corresponding to the fusing nip;

actuating the at least one pneumatic device to the first position to close the fusing nip between the fuser member and the pressure member at the fusing position based on the determined presence of the leading edge of the sheeted substrate at the fusing position;

advancing the sheeted substrate through the fusing nip in the process direction;

determining the sheeted substrate exits the fusing nip by determining a presence of a trailing edge of the substrate at the fusing nip;

actuating the at least one pneumatic device to the second position to open the fusing nip between the fuser member and the pressure member for a duration of time based on the determined exit of the sheeted substrate from the fusing nip to substantially prevent transfer of the release agent from the fuser member to the pressure member, wherein any actuation of the at least one pneumatic device to close and/or open the fusing nip occurs only when the sheeted substrate is present in the fusing nip.

2. The method of claim 1, the determining the presence of the leading edge of the sheeted substrate at the fusing position being based on detecting the leading edge of the sheeted substrate with a first sensor.

3. The method of claim 1, the determining the exit of the sheeted substrate from the fusing nip being based on detecting the trailing edge of the sheeted substrate with a second sensor.

4. The method of claim 1, the at least one pneumatic device being configured to move the pressure member toward the fuser member when actuated to the first position.

5. The method of claim 1, the at least one pneumatic device being configured to move the fuser member toward the pressure member when actuated to the first position.

6. The method of claim 1, the at least one pneumatic device comprising a first pneumatic device configured to move the fuser member toward the pressure member and a second pneumatic device configured to move the pressure member toward the fuser member when each of the first pneumatic device and the second pneumatic device are each actuated to a respective first position.

7. An apparatus useful in printing comprising:

a fuser having a fuser member, a pressure member, a release agent system that applies a release agent to the fuser member; and at least one pneumatic device, at least one of the a fuser member and the pressure member being movable by action of the at least one pneumatic device, the at least one pneumatic device being actuated to a first position to close a fusing nip between the fuser member and the pressure member and being actuated at a fusing position to a second position to open the fusing nip between the fuser member and the pressure member;

at least one processor; and at least one memory including computer program code for one or more programs, the at least one memory and the computer program code being configured to, with the at least one processor, cause the apparatus to perform at least the following:

advancing a sheeted substrate through the fuser in a process direction;

determining a presence of a leading edge of the sheeted substrate at the fusing position corresponding to the fusing nip;

actuating the at least one pneumatic device to the first position to close the fusing nip between the fuser member and the pressure member based on a determined presence of the leading edge of the sheeted substrate at the fusing position;

advancing the sheeted substrate through the fusing nip in the process direction;

determining the sheeted substrate exits the fusing nip by determining a presence of a trailing edge of the sheeted substrate at the fusing nip; and actuating the at least one pneumatic device to the second position to open the fusing nip between the fuser member and the pressure member based on the determined exit of the sheeted substrate from the fusing nip for a duration of time to substantially prevent transfer of the release agent from the fuser member to the pressure member, wherein any actuation of the at least one pneumatic device to close and/or open the fusing nip occurs only when the sheeted substrate is present in the fusing nip.

8. The apparatus of claim 7, the determining the presence of the leading edge of the sheeted substrate at the fusing position being based on detecting the leading edge of the sheeted substrate with a first sensor.

9. The apparatus of claim 7, the determining the exit of the sheeted substrate from the fusing nip being based on detecting the trailing edge of the sheeted substrate with a second sensor.

10. The apparatus of claim 7, the at least one pneumatic device being configured to move the pressure member toward the fuser member when actuated to the first position.

11. The apparatus of claim 7, the at least one pneumatic device being configured to move the fuser member toward the pressure member when actuated to the first position.

12. The apparatus of claim 7, the at least one pneumatic device comprising a first pneumatic device configured to move the fuser member toward the pressure member and a second pneumatic device configured to move the pressure member toward the fuser member when each of the first pneumatic device and the second pneumatic device are each actuated to a respective first position.

* * * * *